US005480097A

United States Patent [19]

Carter, Jr. et al.

[11] Patent Number: 5,480,097

[45] Date of Patent: Jan. 2, 1996

[54] GAS ATOMIZER WITH REDUCED BACKFLOW

[75] Inventors: William T. Carter, Jr., Ballston Lake; Thomas F. Sawyer, Stillwater; Mark G. Benz, Burnt Hills; Mark E. Braaten, Clifton Park, all of N.Y.

[73] Assignee: General Electric Company, Schenectady, N.Y.

[21] Appl. No.: 217,834

[22] Filed: Mar. 25, 1994

[51] Int. Cl.[6] ..... B05B 1/26

[52] U.S. Cl. ..... 239/296; 239/553.3; 266/202

[58] Field of Search ..... 239/290, 296, 239/297, 299, 300, 553.3; 266/201, 202; 164/46, 270.1

[56] References Cited

U.S. PATENT DOCUMENTS

| | | | |
|---|---|---|---|
| 3,542,351 | 11/1970 | Rhydderch | 266/202 |
| 3,558,120 | 1/1971 | Whetton | 266/202 |
| 3,826,301 | 7/1974 | Brooks | 164/46 |
| 3,909,921 | 10/1975 | Brooks | 164/46 |
| 4,624,409 | 11/1986 | Takeda et al. | 239/290 |
| 4,779,802 | 10/1988 | Coombs | 239/292 |
| 4,926,923 | 5/1990 | Brooks et al. | 164/46 |
| 5,160,532 | 11/1992 | Benz et al. | 266/202 |
| 5,242,110 | 9/1993 | Riley | 239/297 |
| 5,314,121 | 5/1994 | Buss et al. | 239/553.3 |

*Primary Examiner*—Karen B. Merritt

*Attorney, Agent, or Firm*—R. Thomas Payne; James Magee, Jr.

[57] ABSTRACT

An improved molten metal spray forming atomization ring converter adapted for the spray forming of a refined molten metal from a molten metal refining or melting chamber wherein the molten metal is atomized into tiny molten droplets by gas impingement in a stream of molten metal and to the structure by which the molten metal droplets are preferentially directed to and deposited on a target surface. The molten metal spray forming atomization ring converter is adapted to control the flow of liquid metal droplets and to avoid a backflow of such droplets during the gas atomization by providing structure, such as small apertures to the inner diameter of the ring, by providing large holes through the inner diameter and adding a porous metal filter to cover the large holes or by providing a gas supply system independent from the atomization system gas supply, such that a pressure or diffused source of gas is provided at the inner bore. These modifications produce a relatively small mass flow of gas sufficient to feed the entrainment requirement of the high speed jets, but sufficiently low enough to avoid preatomization of the liquid metal wherein backsplash of the metal is reduced and/or prevented.

10 Claims, 5 Drawing Sheets

GAS ATOMIZER WITH REDUCED BACKFLOW

BACKGROUND OF THE INVENTION

The present invention relates generally to an improved molten metal spray forming atomizing ring converter and, more particularly, to such a converter particularly adapted for spray forming of a refined molten metal from a molten metal refining or melting chamber. More particularly, it relates to a spray forming process in which molten metal is atomized into tiny molten droplets by gas impingement on a stream of molten metal and to the means by which the molten metal droplets are preferentially directed to and deposited on a target surface. Most particularly, it relates to controlling the flow of liquid metal droplets and avoiding a backflow of such droplets during the gas atomization.

A molten metal spray forming converter is employed to convert a molten metal stream into an expanding metal spray or plume of small molten metal droplets which impinge and deposit on an appropriate collector which can provide a large metal billet or other object of desired metal characteristics.

One example of molten metal refining is referred to as electroslag refining, and is illustrated and described in U.S. Pat. No. 5,160,532— Benz et al, assigned to the same assignee as the present invention.

In an electroslag process, a large ingot of a preferred metal may be effectively refined in a molten state to remove important impurities such as oxides and sulfides which may have been present in the ingot. Simply described, electroslag refining comprises a metal ingot positioned over a pool of molten metal in a suitable vessel or furnace where the molten pool which may include a surface layer of solid slag, an adjacent underlayer of molten slag and a lowermost body of refined molten ingot metal. The ingot is connected as an electrode in an electrical circuit including the molten metal pool, a source of electrical power and the ingot. The ingot is brought into contact with the molten slag layer and a heavy electrical current is caused to flow across the ingot/molten slag interface. This arrangement and process causes electrical resistance heating and melting of the ingot at the noted interface with the molten ingot metal passing through the molten slag layer as a refining medium to then become a part of the body of refined ingot metal. It is the combination of the controlled resistance melting and the passage of molten ingot metal through the molten slag layer which refines the ingot metal to remove impurities such as oxides, sulfides, and other undesirable inclusions.

In metal spray forming, a small stream of refined molten metal from the furnace is caused to pass concentrically through a molten metal spray forming converter generally comprising a closed peripheral manifold having an open central portion. The manifold is equipped with gas inlet means and plural gas jet exit means. A gas under pressure is supplied to the manifold to exit through the gas jets in converging streams which impinge the passing metal stream to convert or break up the metal stream into a generally expanding spray pattern of small molten metal droplets. This spray pattern can then be directed to impinge and deposit on a suitable collector surface to generate a metal billet or other metal object.

The art of spray forming of metals is a well-developed art. A number of patents have issued relating to this art including the following U.S. Pat. Nos.: 3,909,921, 3,826,301, 4,926,923, 4,779,802. These and other patents dealing with the subject of spray forming provide part of an extensive technical background in this subject matter.

Some of these patents and, particularly, the last mentioned patent deal with the problem of achieving precise control of the mass deposition of the metal on the deposition surface. As is pointed out in U.S. Pat. No. 4,779,802, one proposal to improve the control of the mass distribution of the deposited layer of gas atomized metal is set out in British patent specification 1455862 where it is proposed to isolate the spray of atomized particles by the use of a primary set of gas jets for atomization and two sets of secondary jets which are rapidly switched on and off to impart an oscillatory motion to the spray of atomized metal. However, as noted in the U.S. patent referenced above, it was found that the arrangement did not give ideal control of the mass distribution of the metal deposited. Therefore, an alternative proposal for imparting a direction to a spray was suggested as disclosed in European patent application 0127303A. That arrangement involved the switching on and off of individual gas jets which accomplish the function of both atomizing and oscillating the spray. However, both these methods are very difficult to control and, in particular, lack flexibility in operation. One problem with the first proposal is that the use of secondary jets can result in excess cooling of the deposited metal meaning that subsequently arriving particles do not coalesce and properly adhere to the already deposited metal. The problem with the second method is that the shape and properties of the spray can change as individual jets are switched on and off and this makes it extremely difficult to ensure uniform deposition and solidification conditions.

The recitation of this and numerous other problems related to spray forming of metal articles and solutions to such problems are set forth in patents recited above and others relating to this field.

It is believed that during the spray forming process that the dynamic pattern of the gas in the spray forming chamber is important for effective atomization of the liquid metal stream. It has been found that entrainment of gases at the high-speed jets causes a recirculating flow resulting in an upward velocity of gas near the center line of the nozzle. This recirculating flow is undesirable because the liquid metal stream may not have the momentum necessary to carry the liquid metal through this region, resulting in backsplash of the metal, meaning that the liquid metal droplets were being propelled upward. This backsplash may cause problems with the nozzle from which the stream of molten metal exits from the furnace because droplets may freeze on its surfaces, blocking the orifice and possibly causing freeze-off. Thus, the nozzle may be blocked or completely frozen off by the backsplash. Similarly, the spray forming connection may be blocked.

Notwithstanding, the presentations of the art discussed above, there continues to be a need for providing entrainment gases for the atomization jets without developing an excessive recirculating flow. Such a system and method should provide for a small gas flow, sufficient to feed the entrainment requirements of the high speed jets so as to reduce or eliminate the flow recirculation near the nozzle that leads to backsplash. At the same time, this flow must be low enough to avoid preatomization of the liquid metal which could result if this gas flow impinges on the liquid metal stream, causing it to break up prior to reaching the atomization zone.

SUMMARY OF THE INVENTION

In a molten metal refining process a stream of molten metal is caused to pass concentrically through a spray forming manifold ring converter. Plural gas jets from the manifold converge on the passing metal stream to break up the stream into a spray pattern of small molten metal droplets for deposition on a collector or preform surface.

The manifold ring is modified by providing small apertures through the inner diameter of the ring or by providing large holes through the inner diameter and adding a porous metal filter to cover the large holes such that the gas pressure is reduced providing a diffused source of gas at the inner bore.

Both of these modifications produce a relatively small mass flow of gas, sufficient to feed the entrainment requirement of the high-speed jets, but low enough to avoid preatomization of the liquid metal whereby backsplash of the metal is prevented.

One aspect of the present invention relates to a spray forming atomization apparatus which comprises: a spray forming chamber in which a spray of droplets is formed by atomization of a stream of molten metal and in which a deposit of the droplets is made onto a receiving surface; means for supplying a stream of molten metal to the chamber; means for atomizing the stream in the chamber, the atomizing means comprising a gas manifold disposed to encompass the stream of molten metal, the manifold being adapted to receive high pressure gas and to dispense the gas therefrom, the manifold having at least one downwardly directed orifice for impacting in the stream of molten metal after the stream has passed axially through the manifold, the manifold having at least one secondary inwardly directed gas orifice with a flow of gas therefrom at a reduced rate relative to the rate of flow from the at least one downwardly directed orifice, at least one secondary gas orifice being directed radially toward the stream of molten metal such that the backstreaming of gas and entrained droplets and particles in the chamber are reduced without disturbing the molten metal stream.

Accordingly, it is an object of this invention to provide an improved molten metal spray forming atomizing ring converter for a molten metal refining apparatus having means for preventing recirculation flow during atomization which prevents backsplash of the atomized metal.

Other objects and advantages of the invention will be apparent from the following description, the accompanying drawings and the appended claims.

DESCRIPTION OF A PREFERRED EMBODIMENT

In carrying out the present invention in preferred forms thereof, we provide an improved gas atomizer for use with any process involving open atomization, such as spray forming. One illustrated embodiment of the invention disclosed herein, is in the form of a modified nozzle with vectored jets or a diffused gas source in conjunction with an electroslag melting process.

Figure 1:
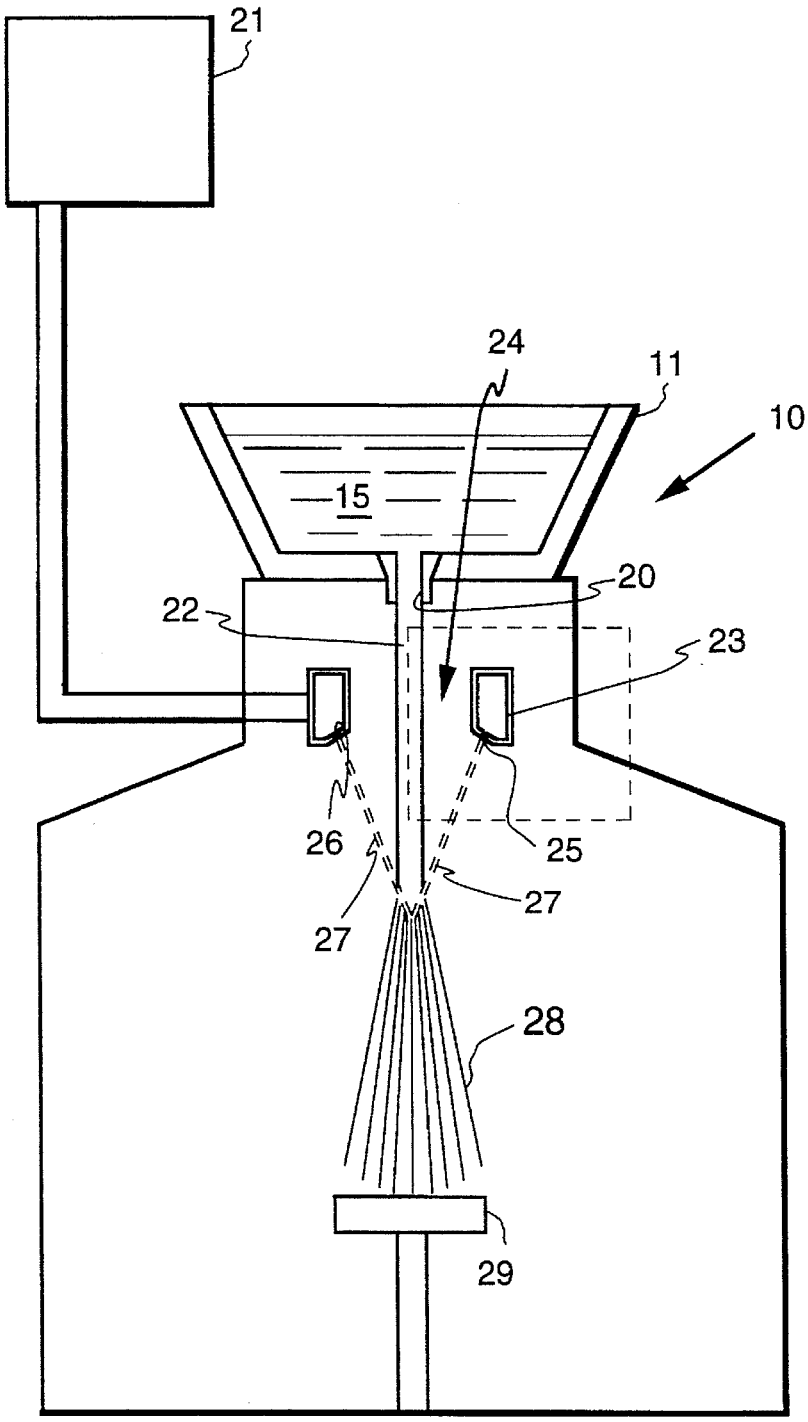
Fig. 1 (PRIOR ART)
FIG. 1 is a partial schematic illustration of an electroslag refining apparatus with a conventional spray forming ring atomizer.

As shown in FIG. 1, an electroslag assembly 10 suitable for use in an electroslag refining process comprises a melting vessel or furnace 11 containing, during operation of assembly 10, a resultant metal supply of ingot metal (not shown). The ingot normally comprises a surface layer of solid slag (not shown), an adjacent underlayer of molten slag and a lowermost pool or body 15 of refined ingot metal. As is well known, a metal ingot to be refined is brought into contact with the molten slag layer 14. As is also known, the metal ingot is connected into an electric circuit as an electrode. Electrical power is then supplied from a suitable power source (not shown) through a conductor (not shown) to the ingot (not shown). An appropriate electrical conductor (not shown) from vessel 11 to the power source completes the circuit. A heavy electrical current flowing across the interface of the ingot and molten slag 14 generates electrical resistance heating sufficient to cause melting of the interface end of the ingot. Molten ingot metal passes through molten slag 14 as a refining procedure and becomes a part of refined metal pool 15.

At the lowermost part of vessel 11 a controlled drain orifice 20 communicates with molten metal pool 15. In order to maintain melting and liquidity of molten metal 15 adjacent orifice 20, an electrical induction, heating coil (not shown) may surround orifice 20 and is connected to a suitable source of electrical power (not shown). By this means a stream of molten metal 22 is caused to flow from orifice 20 through a spray forming atomizer ring converter 23.

In one form, atomizer ring converter 23 comprises a hollow circular ring manifold with a central circular aperture 24 which is concentrically positioned to receive the metal stream 22. Atomizer ring converter 23 also includes a peripheral row of gas jets or orifices 25 in a peripherally continuous tapered or conical edge surface 26. Atomizer ring converter 23 is connected to a source 21 of gas under pressure, and the combination of the gas jet orifices 25 and conical surface 26 provides a plurality of gas streams 27 which converge at a downstream apex on the passing metal stream 22. The controlled interaction of the gas jet streams 27 with metal stream 22 causes metal stream 22 to break down and be converted to an expanding spray plume or pattern 28 of small molten metal droplets.

Spray pattern 28 may be directed against a collector 29 to provide, for example, a billet of refined ingot metal or other ingot metal objects. Collector 29 may be a fixed or moving surface including a rotating surface such as the surface of a rotating cylinder or mandrel. The efficiency and effectiveness of deposition of molten metal spray plume 28 on a collector surface to provide a refined metal object is facilitated and improved when the spray pattern 28 may be angularly adjusted with respect to the collector.

Figure 2:
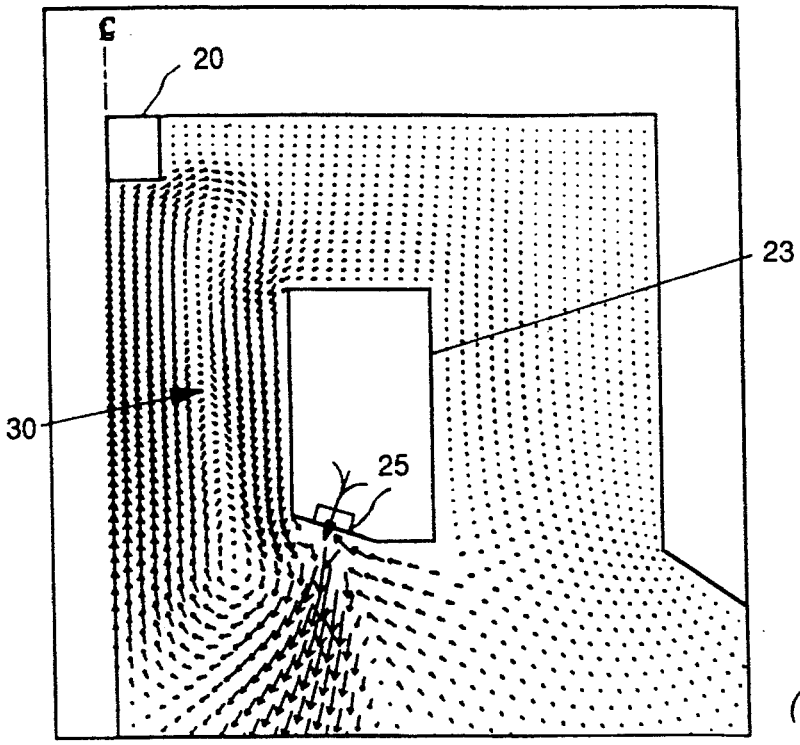
Fig.2 (PRIOR ART)
FIG. 2 is an illustration of the vectors relating to gas flow in a prior type of spray forming device (without the metal stream)

The flow pattern in the gas atomizer was investigated numerically using a two-dimensional axisymmetric computational fluid dynamic analysis computer program. The results for the prior art design are shown in FIG. 2. The calculations indicated the presence of a flow recirculation zone 30 in which the direction of gas flow along the center line is upwardly directed towards the liquid metal nozzle 20. It is this recirculation that is believed responsible for the metal backsplash problem shown in FIG. 3. The cause of this recirculation zone is the entrainment requirement of a high speed atomization jet.

Figure 3:
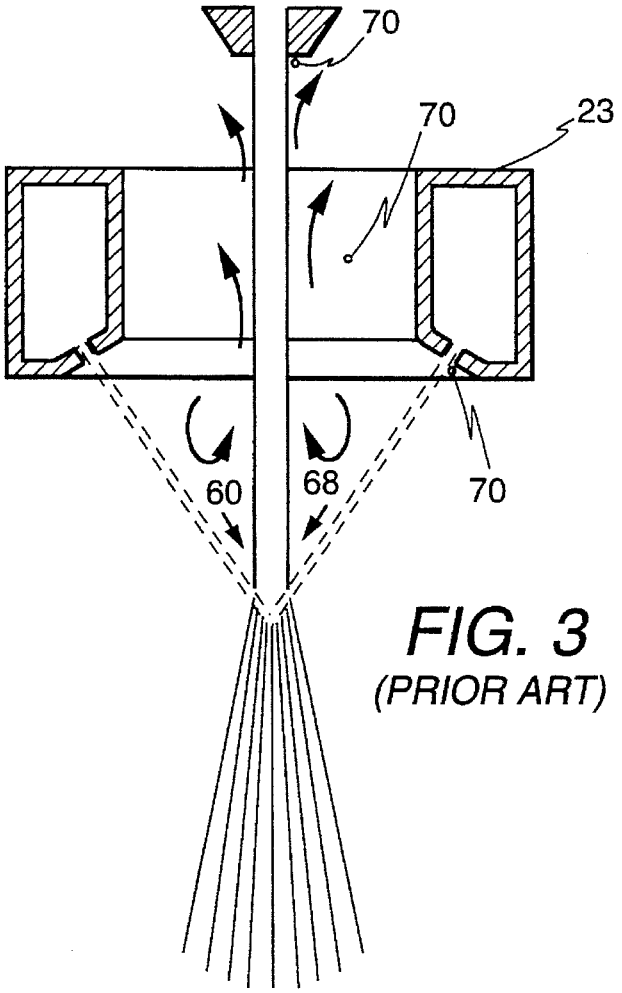
FIG. 3 (PRIOR ART)
FIG. 3 is a partial schematic illustration of a conventional spray forming ring atomizer showing the gas backflow during operation of the atomizer.

In our prior art arrangement, as shown in FIG. 3, the only possible gas source for the recirculation gas was the impacting gas downstream from the converter, which appears to cause an undesirable recirculation zone and thus cause backsplash.

Figure 4:
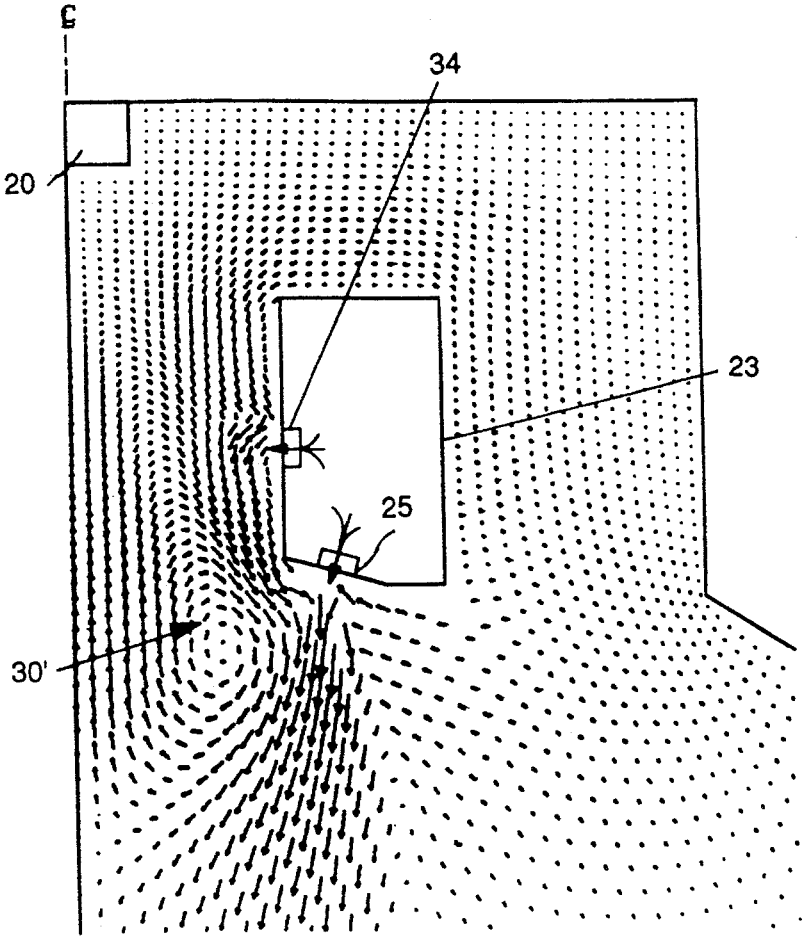
FIG. 4 is a modified display of vectors associated with gas flow of the present invention.

The present invention described herein provides additional control flow to feed the high speed jet's entrainment requirement without the resulting recirculation zone. The results of an analysis of this configuration is shown in FIG. 4 where a control gas flow 34 is directed radially inward above the atomization jets 25. This control gas results in a substantial decrease in the strength of the recirculation zone 30', when compared to the recirculation zone 30 of FIG. 2.

Based on this favorable prediction, a prototype of the open atomizer converter was manufactured and tested. The test showed the atomizer of the present invention to be effective in preventing backsplash. The atomizer of the present invention provides entrainment gases at the inner diameter of the atomizer 23 to prevent backsplash.

Figure 7:
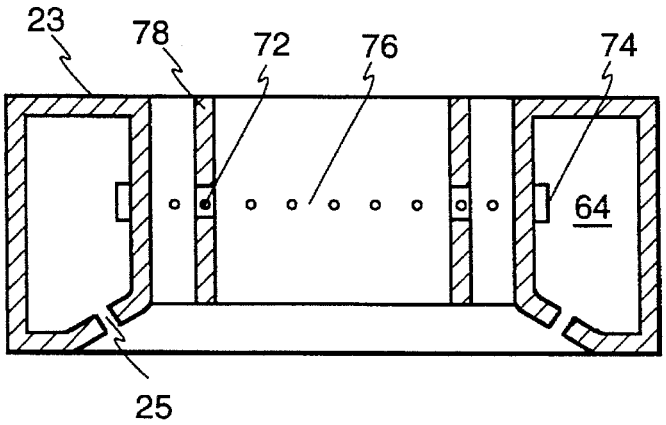
FIG. 7 is a cross-sectional view similar of another alternative form of a gas nozzle structure usable with the present invention.

While the following example is illustrative of the porous metal insert diffused version of the atomizer of the present invention, it is believed that a separate gas source as illustrated in FIG. 7 could be utilized in place of either the diffused design or the smaller jet design.

Figure 5:
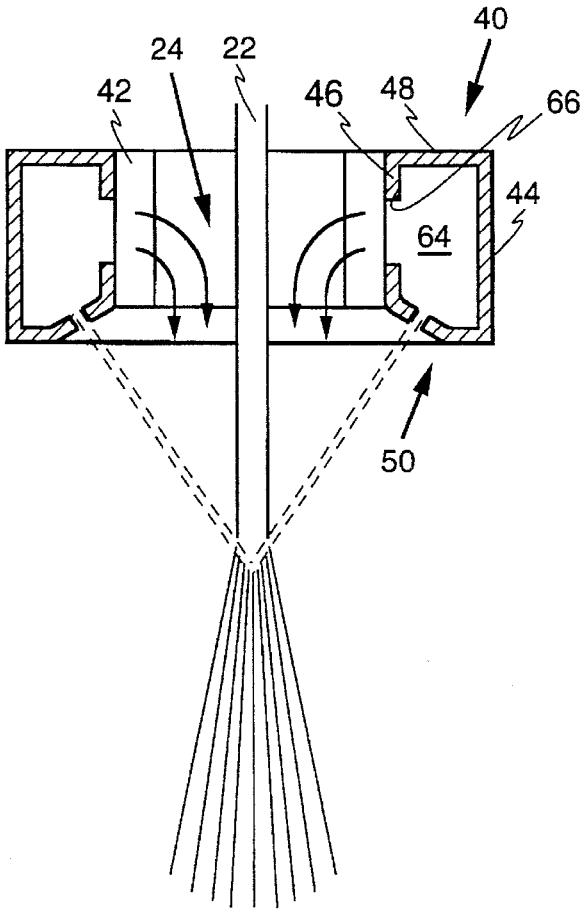
FIG. 5 is a partial view of a gas nozzle structure showing the converter ring in section utilizing one embodiment of the present invention during operation of the system.
Figure 6:
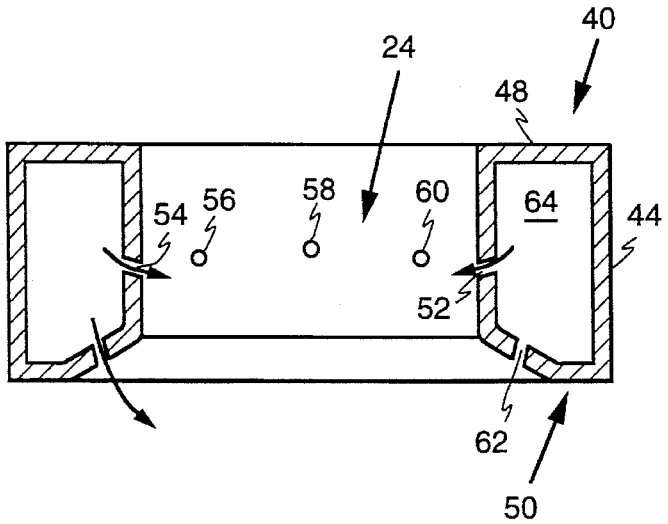
FIG. 6 is a cross-sectional view of an alternate gas nozzle structure usable with the present invention.

As shown in FIGS. 5 and 6, alternative embodiments of an open atomizer ring converter are illustrated. The atomizer ring converter 40 comprises a manifold member having two sidewalls 44, 46 and a top 48 and a bottom 50 wall. The inner sidewall 46, which is normally solid, has been modified to contain at least one jet 52 but, in fact, may contain more jets around its periphery, such as 54, 56, 58 and 60. The bottom wall 50 contains primary jets 62, which are the jets primarily responsible for directing gas from the interior 64 of the manifold toward the stream of the molten metal 22.

As shown in FIG. 5, another jet 66 is formed in the inner wall 46 and is subsequently covered by the porous metal insert 42.

During operation, the gas exiting the primary jet 62 is at a higher rate of flow than the gas exiting the secondary jet 52 or the porous metal insert 42. This gas source is sufficient to prevent backsplash but is not of such a magnitude that it would interfere with the flow of the stream of molten metal as it passes inside of the inner wall 46 of the atomizer ring converter 40.

Example

An insert 42 was machined from a porous stainless steel bushing and fitted into an existing atomizer ring converter 40 as shown in FIG. 5. A 20μ grade of 316SS was chosen to allow a substantial pressure drop across the insert 42 thickness into the atomizer bore 24. A duplicate insert was machined from a solid material so that pressure measurements could be compared.

Pressure Measurements

Figure 8:
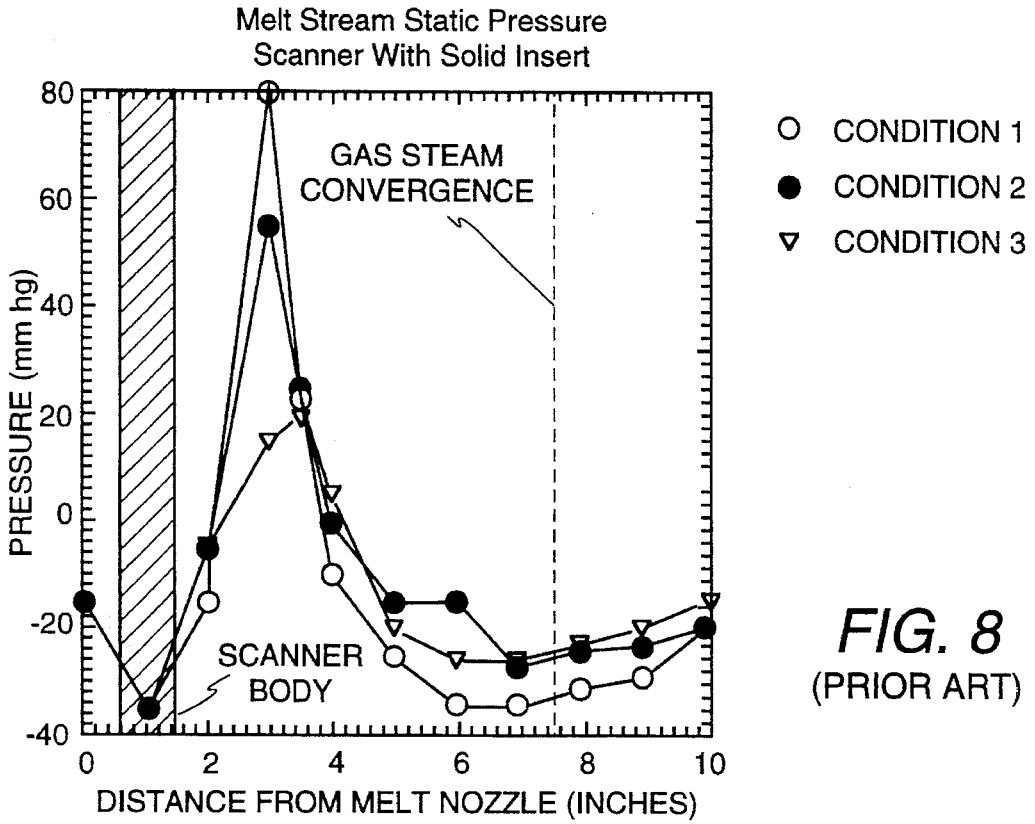
FIG. 8 (PRIOR ART)
FIG. 8 is a graphic representation of the melt stream static pressure of the prior art ring converter.
Figure 9:
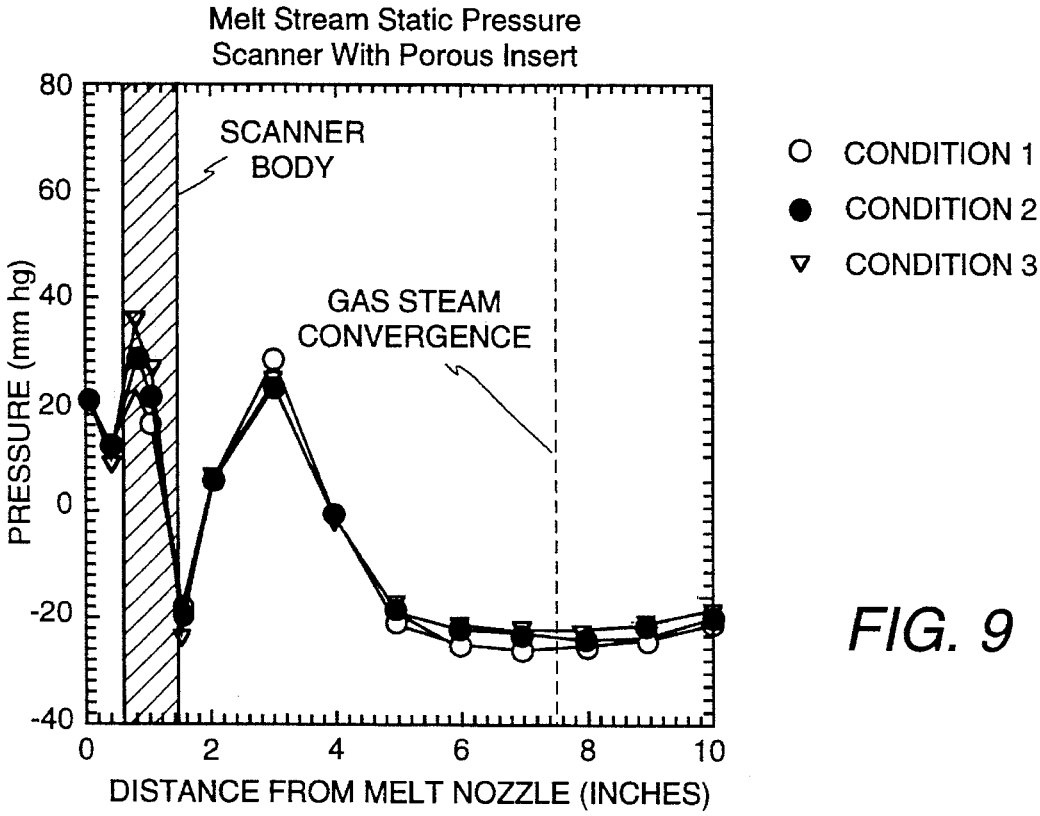
FIG. 9 is a graphic representation of the melt stream static pressure of a ring converter having a porous insert therein.

The first set of tests involved pressure measurements in the absence of the molten metal stream. Static pressure measurements were taken at locations starting from the exit of the crucible nozzle to a point below the convergence of the atomizing gas. The pressure measurements generated two families of curves as shown in FIGS. 8 and 9. FIG. 8 shows the static pressure as a function of distance below the melt nozzle for three atomization conditions using the solid insert. These conditions simulated those used for atomization runs which were observed to cause the molten metal stream to be both stable (condition 3) and unstable (condition 1).

FIG. 9 shows a similar plot for the case of the porous metal insert. The same three spray forming conditions are plotted. It was noted during the test that, as conditions were changed, the measurements taken with the porous insert stabilized more quickly than the same measurements with the solid insert. It is clear from the plot that the variation in pressure between the three spray forming conditions is smaller than the variations shown in FIG. 8.

Molten Metal Trials

Experiments using the porous insert 42 were performed while observing the stability of a molten metal stream visually and with a video camera. Generally, a stable melt stream was achieved for the desired operating conditions.

The pressures indicated by the open circles in FIG. 8 are known to produce destabilizing forces on the melt stream 22 as it enters the atomization zone 68. Globules of molten metal 70 (see FIG. 3) are ejected upward from the melt stream 22 toward the atomizer ring converter 23. This is known as "backsplash". Experiments have shown that this condition often results in complete blockage of the atomizer ring converter 23 and liquid metal nozzle 20 Photographs taken while atomizing under the same conditions with the porous metal insert 42 show a stable liquid metal stream 22 above a stable atomization zone 68.

Thus, the above experiment clearly illustrates that the utilization of the porous metal insert 42 to provide a gas flow in the area between the atomization zone and the exit port of the metal stream prevented backsplash and would maintain gas flow through the atomizer ring converter 23 with no blockages resulting therein.

The above-discussed alternative embodiments involved utilizing the same gas for both the primary and the secondary jets. As long as the high pressure gas inside the converter remained constant, the relative pressures between the primary and secondary jets also remained constant. Additionally, during an increase or decrease of pressure, the rate of the primary to secondary should remain approximately the same resulting in a self-regulation system. Those particular configurations, however, did not provide for the independent control of the secondary jet pressure.

As shown in FIG. 7, an independent low pressure gas source to the secondary jets 72 is illustrated. These particular secondary jets are an outlet for gas which is independently distributed from a source (not shown). The cavities for the gas to move to the jets or other distributing structures 74, 78 may be internally placed in the cavity 64 in the high pressure area or moved externally on the surface of the inner wall 76, or any other method which will independently deliver a second gas at a lower pressure to the jets on the inner surface 76 of the atomizer ring converter 23. Independent control of the atomizing control gases may be desirable for some spray forming configuration.

While this invention has been disclosed and described with respect to a preferred embodiment, it will be understood by those skilled in the art that various changes and modifications may be made without departing from the spirit and scope of the invention.

What is claimed is:

1. A spray forming converter for atomizing a molten metal comprising:

a manifold for receiving a gas therein and for passing a stream of molten metal therethrough;

at least one primary gas directing structure, including at least three jets about the periphery of the manifold, operatively positioned in the manifold, for directing the gas through the at least one primary gas directing structure such that the gas engages the molten metal stream after passing through the manifold for converting the metal stream into a spray pattern of molten metal droplets; and at least one secondary gas directing structure, operatively positioned in the manifold, for providing a gas pressure magnitude sufficient to prevent backsplash but not of sufficient magnitude that the gas from the secondary gas directing structure interferes with the flow of the stream of molten metal as the stream passes inside the manifold.

2. The converter of claim 1 wherein the at least one secondary gas directing structure comprises: at least three jets about the inner periphery of the manifold.

3. A spray forming atomization system comprising:

a chamber;

a stream of molten metal;

means for supplying the stream of molten metal to the chamber;

at least one gas for atomizing the stream in the chamber to produce a spray of molten droplets, wherein the at least one atomizing gas comprises:

a gas manifold, operative to receive and disperse the gas therefrom, for encircling the stream;

at least one primary gas directing means, including at least three jets about the periphery of the manifold, having entrainment requirements, operatively positioned in the manifold, for directing a first gas flow so that the first gas flow impacts the stream after the stream has passed axially through the manifold; and at least one secondary inwardly directed gas directing means, operatively positioned in the manifold, for directing a second gas flow, the second gas flow having a magnitude less than the first gas flow and being sufficient to feed the entrainment requirements of the first gas flow such that flow recirculation is reduced and preatomization of the stream is avoided.

4. The system of claim 3 wherein the at least one secondary gas directing structure comprises: at least three jets about the inner periphery of the manifold.

5. A spray forming atomization apparatus comprising:

a spray forming chamber in which a spray of droplets is formed by atomization of a stream of molten metal and in which a deposit of the droplets is made onto a receiving surface;

means for supplying a stream of molten metal to the chamber; and means for atomizing the stream in the chamber, the atomizing means comprising:

a gas manifold disposed to encompass the stream of molten metal, the manifold being adapted to receive high pressure gas and to dispense the gas therefrom, the manifold having at least one downwardly directed orifice for impacting in the stream of molten metal after the stream has passed axially through the manifold, the manifold having at least three secondary inwardly directed gas orifices with a flow of gas therefrom at a reduced rate relative to the rate of flow from the at least one downwardly directed orifice, the at least three secondary gas orifices being directed radially toward the stream of molten metal such that the backstreaming of gas and entrained droplets and particles in the chamber are reduced without disturbing the molten metal stream.

6. The apparatus of claim 5 wherein the at least one downwardly directed orifice of the manifold comprises at least three orifices about the periphery of the manifold for impacting in the stream of molten metal after the stream has passed axially through the manifold.

7. A spray forming atomization system comprising:

a chamber;

a stream of molten metal;

means for supplying the stream of molten metal to the chamber;

at least one gas for atomizing the stream in the chamber to produce a spray of molten droplets, wherein the at least one atomizing gas comprises:

a gas manifold, operative to receive and disperse the gas therefrom, for encircling the stream;

at least one primary gas directing means having entrainment requirements, operatively positioned in the manifold, for directing a first gas flow so that the first gas flow impacts the stream after the stream has passed axially through the manifold; and at least one secondary inwardly directed gas directing means, including at least three jets about the inner periphery of the manifold, operatively positioned in the manifold, for directing a second gas flow, the second gas flow having a magnitude less than the first gas flow and being sufficient to feed the entrainment requirements of the first gas flow such that flow recirculation is reduced and preatomization of the stream is avoided.

8. The system of claim 7 wherein the at least one primary gas directing means comprises: at least three jets about the periphery of the manifold.

9. A spray forming converter for atomizing a molten metal comprising:

a manifold for receiving a gas therein and for passing a stream of molten metal therethrough;

at least one primary gas directing structure, operatively positioned in the manifold, for directing the gas through the at least one primary gas directing structure such that the gas engages the molten metal stream after passing through the manifold for converting the metal stream into a spray pattern of molten metal droplets; and at least one secondary gas directing structure, including at least three jets about the inner periphery of the manifold, operatively positioned in the manifold, for providing a gas pressure magnitude sufficient to prevent backsplash but not of sufficient magnitude that the gas from the secondary gas directing structure interferes with the flow of the stream of molten metal as the stream passes inside the manifold.

10. The converter of claim 9 wherein the at least one primary gas directing structure comprises:

at least three jets about the periphery of the manifold.

* * * * *